US012336637B1

(12) United States Patent
Zhong

(10) Patent No.: US 12,336,637 B1
(45) Date of Patent: Jun. 24, 2025

(54) INFLATABLE SPONGE MAT

(71) Applicant: Wuzhou Baofeng Plastic Products Co., Ltd., Wuzhou (CN)

(72) Inventor: Bo Zhong, Wuzhou (CN)

(73) Assignee: Wuzhou Baofeng Plastic Products Co., Ltd., Wuzhou (CN)

( * ) Notice: Subject to any disclaimer, the term of this patent is extended or adjusted under 35 U.S.C. 154(b) by 0 days.

(21) Appl. No.: 18/961,557

(22) Filed: Nov. 27, 2024

(30) Foreign Application Priority Data

Sep. 2, 2024 (CN) ..... 202422148880.9

(51) Int. Cl.
*A47C 27/08* (2006.01)
*A47C 27/00* (2006.01)

(52) U.S. Cl.
CPC ..... *A47C 27/082* (2013.01); *A47C 27/087* (2013.01); *A47C 27/088* (2013.01); *A47C 27/081* (2013.01)

(58) Field of Classification Search
CPC ... A47C 27/082; A47C 27/087; A47C 27/088; A47C 27/081; A47C 27/08; A61G 7/05769
USPC ..... 5/713, 709, 711, 712, 706, 654, 655.3, 5/644
See application file for complete search history.

(56) References Cited

U.S. PATENT DOCUMENTS 2,997,100 A * 8/1961 Morris ..... A47C 27/18 5/709
3,378,864 A * 4/1968 Cornes ..... B63C 9/081 92/92
3,675,377 A * 7/1972 Suter ..... B63B 7/08 206/522
3,872,525 A * 3/1975 Lea ..... A47C 27/088 5/709
4,025,974 A * 5/1977 Lea ..... B29C 66/8181 5/709
4,149,919 A * 4/1979 Lea ..... B29C 66/0342 156/213
4,261,776 A * 4/1981 Lea ..... A47C 27/088 156/213
RE31,898 E * 5/1985 Suter ..... B65D 90/02 428/317.1
5,117,517 A * 6/1992 Su ..... A47C 27/18 5/699
5,325,551 A * 7/1994 Tappel ..... A47C 27/082 5/709
5,329,656 A * 7/1994 Leggett ..... A47C 27/18 5/709

(Continued)

*Primary Examiner* — Robert G Santos
(74) *Attorney, Agent, or Firm* — Cooper Legal Group, LLC

(57) ABSTRACT

The present application discloses an inflatable sponge mat, including a top sheet, a bottom sheet, a side enclosing sheet and a bed mat, wherein four edges of the top sheet are connected to the top of the side enclosing sheet, four edges of the bottom sheet are connected to the bottom of the side enclosing sheet; the top sheet, the bottom sheet and the side enclosing sheet enclose to form an air chamber, the bed mat is arranged in the air chamber, an upper surface of the bed mat is fixedly connected to a lower surface of the top sheet, and a lower surface of the bed mat is fixedly connected to an upper surface of the bottom sheet; the side enclosing sheet is provided with an air pumping assembly. The bed mat provided in the present application provides stable support and comfort in use.

15 Claims, 7 Drawing Sheets

(56) References Cited

U.S. PATENT DOCUMENTS

| | | | | | |
|---|---|---|---|---|---|
| 5,452,487 | A * | 9/1995 | Leggett | A47C 27/084 | 5/709 |
| 5,630,237 | A * | 5/1997 | Ku | A47C 27/084 | 5/709 |
| 5,669,092 | A * | 9/1997 | Lin | B32B 15/08 | 5/709 |
| 5,974,608 | A * | 11/1999 | Haller | A47C 27/084 | 5/709 |
| 6,190,486 | B1 * | 2/2001 | Switlik | A47C 27/084 | 156/308.2 |
| 6,260,222 | B1 * | 7/2001 | Lin | A47C 27/081 | 5/709 |
| 6,397,417 | B1 * | 6/2002 | Switlik | A47C 27/148 | 5/709 |
| 6,651,277 | B1 * | 11/2003 | Marson | A47C 27/15 | 5/709 |
| 2003/0217414 | A1 * | 11/2003 | Marson | B32B 5/32 | 5/709 |

* cited by examiner

INFLATABLE SPONGE MAT

CROSS-REFERENCE TO RELATED APPLICATION

The present application claims the priority and benefit of Chinese patent application No. 202422148880.9, filed on Sep. 2, 2024. The entirety of Chinese patent application No. 202422148880.9 is hereby incorporated by reference herein and made a part of this specification.

TECHNICAL FIELD

The present application relates to a field of inflatable mats, and more particularly to an inflatable sponge mat.

BACKGROUND ART

Because of its portability and easy storage, an inflatable mattress is popular in outdoor activities and domestic use. At present, most sleeping mats on the market are inflatable, and a closed air chamber is formed by sealing and connecting a top sheet, a bottom sheet and a side enclosing sheet to realize an inflatable function of a mattress. The inflatable mattress can be used after being fully inflated, but traditional inflatable mattresses often cause an imbalance in internal pressure due to uneven weight distribution or body movement during long-term use, resulting in a deformation of the mattress and affecting a comfort of use.

In this regard, an internal air column structure or a plurality of wire-drawn structures provided with a grid layout mode are currently used on the market to improve a support force of the mattress, but the internal air column structure is also by inflating or deflating to adjust a support of the mattress, which is also easy to cause uneven local pressure of the mattress due to uneven weight distribution or body movement during use. Meanwhile, after the mattress is inflated, the wire-drawn structure will pull a connection with the top sheet and the bottom sheet inwards, so that a plurality of concave connection point locations appear on a surface of the mattress, reducing a flatness and comfort of a sleeping area of the mattress.

SUMMARY

In order to solve a problem of support stability of the inflatable mattress, the present application provides an inflatable sponge mat.

The inflatable sponge mat provided in the present application adopts the following technical solution.

An inflatable sponge mat including a top sheet, a bottom sheet, a side enclosing sheet and a bed mat, wherein four edges of the top sheet is connected to a top of the side enclosing sheet, four edges of the bottom sheet is connected to a bottom of the side enclosing sheet; the top sheet, the bottom sheet and the side enclosing sheet enclose to form an air chamber, the bed mat is arranged in the air chamber, an upper surface of the bed mat is fixedly connected to a lower surface of the top sheet, and a lower surface of the bed mat is fixedly connected to an upper surface of the bottom sheet; the side enclosing sheet is provided with an air pumping assembly.

By adopting the above-mentioned technical solution, the bed mat provides a stable supporting force and comfort for a bed, and a fixed connection of the bed mat with the top sheet and the bottom sheet can increase a stability of the bed mat and prevent the bed mat from shifting or folding during use.

On the other hand, at present, in autumn and winter or in northern regions with higher latitudes, there is a colder skin feel when using inflatable beds, which reduces the comfort of use. In this regard, the present application uses a bed mat with better thermal insulation performance to reduce a heat conduction and diffusion of the bed and improve the comfort of using the inflatable sponge mat.

In some embodiments, the inflatable sponge mat further includes a first pull strap, wherein the first pull strap surrounds a side wall of the bed mat, a top of the first pull strap is connected to the top sheet, and a bottom of the first pull strap is connected to the bottom sheet.

By adopting the above-mentioned technical solution, a surrounding arrangement of the first pull strap on the bed mat can effectively prevent a deformation or displacement of the bed mat caused by pressure or movement during use, and ensure the stability and comfort of the bed mat.

In some embodiments, the first pull strap is defined with a plurality of first through holes.

In some embodiments, the first pull strap is a mesh pull strap.

By adopting the above-mentioned technical solution, while ensuring a strength of the first pull strap, an overall weight of the first pull strap can be reduced and a gas permeability can be improved. On one hand, the mesh pull strap can ensure that a user can keep dry and comfortable in a hot or sweaty environment, and on the other hand, the mesh pull strap can ensure that when the air chamber is inflated, a gas filled can enter micropores of the bed mat through the first through hole or meshes of the mesh pull strap to ensure the support stability and comfort of the bed mat.

In some embodiments, a height of the first pull strap is less than that of the bed mat.

By adopting the above-mentioned technical solution, when the inflatable sponge mat is inflated for use, the first pull strap pulls the top sheet and the bottom sheet inwards, thereby enabling the top sheet, the bottom sheet and the first pull strap to wrap around the bed mat stably, which prevents the bed mat from being easily displaced or deformed due to pressure during use, thereby ensuring the support stability of the bed mat.

In some embodiments, the air pumping assembly is an air pumping integrated device and/or an inflating and deflating air nozzle.

By adopting the above-mentioned technical solution, an operation of inflating and deflating the air chamber is diversified to adapt to requirements of different use scenarios; for example, the air pumping integrated device can realize an integration of inflation and deflation; by arranging the inflating and deflating air nozzle, other separate external inflation and deflation integrated pumps can be used in connection with the inflating and deflating air nozzle to perform an inflation or deflation operation on the air chamber; the air pumping integrated device and the inflating and deflating air nozzle can also be arranged at the same time to make the inflation or deflation operation diversified.

In some embodiments, the inflatable sponge mat further includes a pillow mat, wherein the pillow mat is arranged in the air chamber and close to one end of the top sheet; an upper surface of the pillow mat is fixedly connected to the lower surface of the top sheet and a lower surface of the pillow mat is fixedly connected to the upper surface of the bottom sheet.

By adopting the above-mentioned technical solution, an integrated design of the pillow mat and the bed mat can be realized, saving a trouble of carrying an additional pillow, reducing a travel load, suitable for outdoor camping or temporary rest and other scenarios, improving a convenience of using the inflatable sponge mat and providing a stable supporting force for the inflatable sponge mat. In addition, the pillow mat is also fixedly connected to the top sheet and the bottom sheet to avoid deformation or displacement caused by pressure or movement during use, and is comfortable to use.

In some embodiments, the inflatable sponge mat further includes a second pull strap, wherein the second pull strap surrounds a side wall of the pillow mat, a top of the second pull strap is connected to the top sheet, and a bottom of the second pull strap is connected to the bottom sheet.

In the present application, an effect of the second pull strap is similar to the first pull strap.

In some embodiments, the second pull strap is defined with a plurality of second through holes.

In some embodiments, the second pull strap is the mesh pull strap.

In some embodiments, the second pull strap is provided with at least one one-way air nozzle, and the bottom sheet is provided with an air inlet nozzle at a position corresponding to the pillow mat, and the one-way air nozzle is used for limiting a gas from flowing only from the pillow mat into the air chamber.

By adopting the above-mentioned technical solution, an additional inflation method can be provided for the inflatable sponge mat to improve an inflation efficiency, and the one-way air nozzle is provided inside the air chamber, and the integrated design can reduce a foreign body sensation of accessories to a human body during use and make the use comfortable. Specifically, an elastic force of the pillow mat provides a compression and rebound function, and the micropores of the pillow mat can contain gas, and when the pillow mat is compressed, the gas in the micropores of the pillow mat flows into the air chamber through the one-way air nozzle; when the pillow mat rebounds to an original state, a volume of the micropores of the pillow mat are compressed and a negative pressure is formed in the micropores during a process of returning the original state, which sucks in external air from the air inlet nozzle into the pillow mat, and the negative pressure of the micropores of the pillow mat also seals the one-way air nozzle, so that when the pillow mat returns to the original state to suck air, no air is input into the air chamber, thereby using a compression resilience of the pillow mat to inflate the air chamber.

In some embodiments, the one-way air nozzle includes a connecting seat and a one-way diaphragm, a through hole is defined in a middle of the connecting seat, the through hole penetrates through both surfaces of the connecting seat, and a connecting disc is provided on a hole wall of the connecting seat corresponding to the through hole, the connecting disc is defined with a connecting hole and a plurality of vents, and the one-way diaphragm covers the plurality of vents;

the one-way diaphragm is provided with a connecting column on one surface close to the pillow mat, a middle of the connecting column is defined with an annular clamping groove along a circumferential direction thereof, the connecting column passes through the connecting hole, and the annular clamping groove is clamped in the connecting hole.

By adopting the above-mentioned technical solution, a one-way flow of gas from the pillow mat to the air chamber can be realized, so that the inflation operation of the inflatable sponge mat is facilitated and the use thereof is convenient. Specifically, the one-way diaphragm is connected to the connecting disc through the connecting column and the annular clamping groove; when the pillow mat is compressed, the volume of the micropores of the pillow mat decreases and an air pressure increases, which causes the one-way diaphragm to separate from the bottom of the connecting disc and form a certain gap; the one-way diaphragm releases the seal against the vent;

the annular clamping groove remains clamped in the connecting hole; an end of the connecting column is limited to one side of the connecting disc close to the pillow mat, facilitating a flow of gas from the micropores of the pillow mat into the air chamber. However, when the compression of the pillow mat is released, the elastic force of the pillow mat itself promotes the pillow mat to return the original state, the volume of the micropores of the compressed pillow mat increases and the air pressure decreases, which causes the one-way diaphragm to press against the bottom of the connecting disc, and the connecting hole and a plurality of vents are sealed. At the same time, the negative pressure thereof promotes an outside air to enter the pillow mat through the air inlet nozzle, so that the pillow mat itself completes the inflation of the micropores.

In some embodiments, an axial length of the annular clamping groove is greater than a thickness of the connecting disc.

By adopting the above-mentioned technical solution, a certain gap space can be provided between the one-way diaphragm and the bottom of the connecting disc; when the pillow mat is compressed, the one-way diaphragm is separated from the bottom of the connecting disc, and the seal against the vent is released; and the end of the connecting column is limited at the side of the connecting disc close to the pillow mat, and the gas in the micropores of the pillow mat can flow into the air chamber through the vent and the gap space, which is flexible and convenient to use.

In some embodiments, an outer wall of the connecting seat is provided with a connecting ring along a circumferential direction thereof, and the connecting ring is fixedly connected to the second pull strap.

By adopting the above-mentioned technical solution, a connection stability between the one-way air nozzle and the second pull strap can be improved, an installation process of the one-way air nozzle is simplified, and a production efficiency of products is improved.

In some embodiments, a height of the second pull strap is less than that of the pillow mat.

In summary, the present application includes at least one of the following beneficial technical effects.

1. In the present application, the air chamber is formed by surrounding the top sheet, the bottom sheet and the side enclosing sheet, and a bed mat is provided inside, wherein the bed mat provides stable support and comfort in use, so that the inflatable sponge mat is convenient to carry and has good comfort. During use, the bed is not easy to deform or partially collapse due to uneven pressure, and the thermal insulation performance of the bed mat also enables the inflatable sponge mat suitable for autumn and winter seasons, with high practicality.
2. The pillow mat provided in the present application realizes the integrated design of the bed, without a need to carry additional pillows, reducing the travel burden, suitable for outdoor camping or temporary rest scenarios, and improving the convenience of using the inflatable sponge mat.

DETAILED DESCRIPTION

The present application will be further described in details referring to FIGS. 1-14.

The embodiments of the present application disclose an inflatable sponge mat.

Embodiment 1

Figure 1:
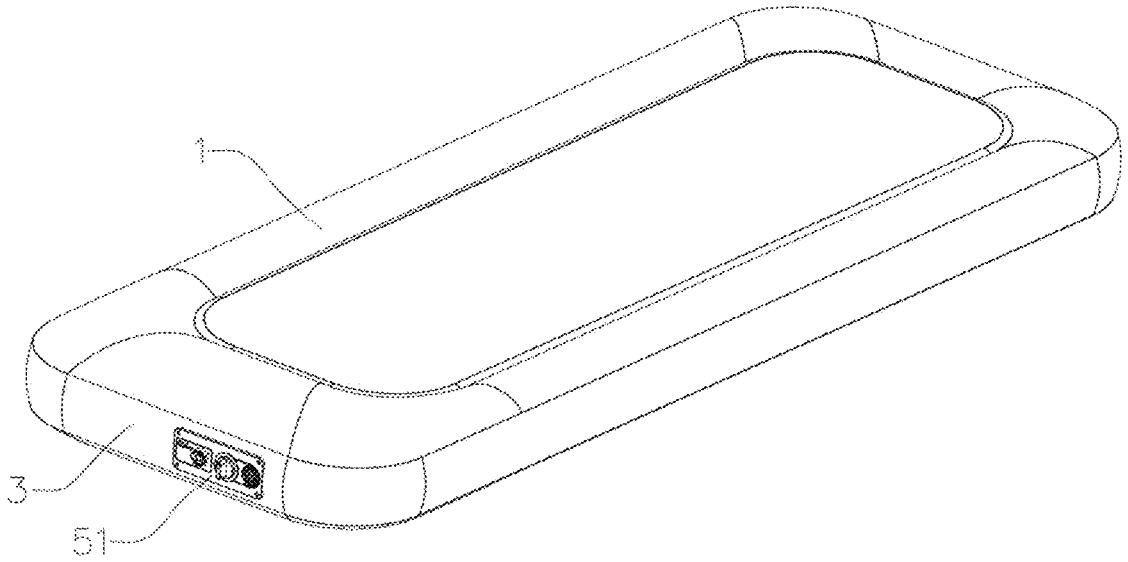
FIG. 1 is a schematic view of a first three-dimensional structure of an inflatable sponge mat according to Embodiment 1 of the present application.
Figure 2:
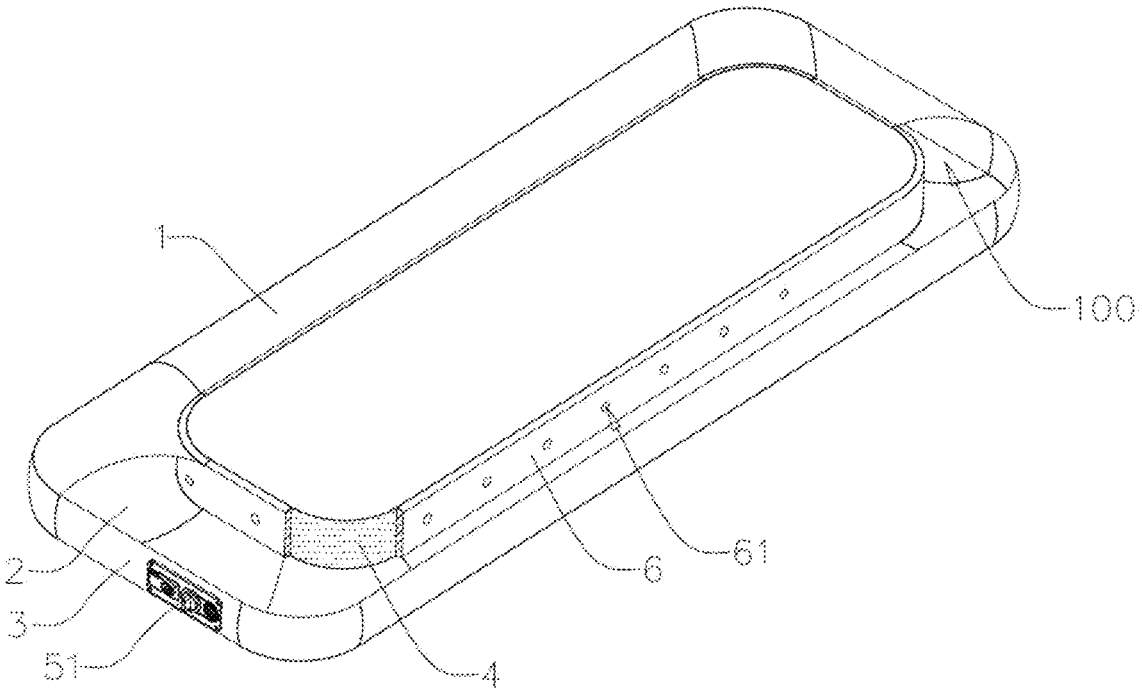
FIG. 2 is a schematic view of a second three-dimensional structure of an inflatable sponge mat according to Embodiment 1 of the present application (wherein the top sheet is partially cut away and the first pull strap is partially cut away).

Referring to FIGS. 1 and 2, the inflatable sponge mat includes a top sheet 1, a bottom sheet 2 and a side enclosing sheet 3, wherein four edges of the top sheet 1 is connected to a top of the side enclosing sheet 3, and four edges of the bottom sheet 2 is connected to a bottom of the side enclosing sheet 3, so that the top sheet 1, the bottom sheet 2 and the side enclosing sheet 3 enclose to form a bed frame structure with an air chamber 100, and the above-mentioned connection method is preferably connected to each other by using a hot-connection or an adhesive process. Further, the bed frame structure is provided with a bed mat 4 and a first pull strap 6, wherein two end portions of the first pull strap 6 are connected end to end, and the first pull strap 6 surrounds a side wall of the bed mat 4, an upper surface of the bed mat 4 is fixedly connected to a lower surface of the top sheet 1, a lower surface of the bed mat 4 is fixedly connected to an upper surface of the bottom sheet 2, a first side edge of the first pull strap 6 located at the top is fixedly connected to the top sheet 1, and a second side edge of the first pull strap 6 located at the bottom is fixedly connected to the bottom sheet 2, and the above-mentioned fixed connection method is preferably connected to each other by using the hot-connection or the adhesive process. Specifically, a distance between the lower surface of the top sheet 1 and the upper surface of the bottom sheet 2 is smaller than a height of the bed mat 4, and a height of the first pull strap 6 is also less than that of the bed mat 4, so that the top sheet 1, the bottom sheet 2 and the first pull strap 6 can stably wrap around and fix the bed mat 4; when the air is inflated in the air chamber 100, the upper surface of the bed mat 4 and the top sheet 1, and the lower surface of the bed mat 4 and the bottom sheet 2 are not easily peeled away due to an air pressure, ensuring a stability of the inflatable sponge mat in use.

Preferably, the first pull strap 6 is fixedly attached to the side wall of the bed mat 4, or the first pull strap 6 is not fixedly attached to the side wall of the bed mat 4, both of which are within a scope of protection of the present application. In addition, the first pull strap 6 is defined with a plurality of first through holes 61, or the first pull strap 6 is a mesh pull strap with a plurality of meshes, both of which are within the scope of protection of the present application. In addition, a ratio of a cross-sectional area of the bed mat 4 to a cross-sectional area of the top sheet 1 is preferably (0.65-1):1, so that a larger part of the inflatable sponge mat is an area of the bed mat 4 used for sleeping and lying, thereby preventing local collapse and instability of the inflatable sponge mat due to compression, in particular, the ratio of the cross-sectional area of the bed mat 4 to the cross-sectional area of the top sheet 1 is preferably 0.65:1, 0.7:1, 0.75:1, 0.8:1, 0.85:1, 0.9:1, 0.95:1 or 1:1.

Figure 3:
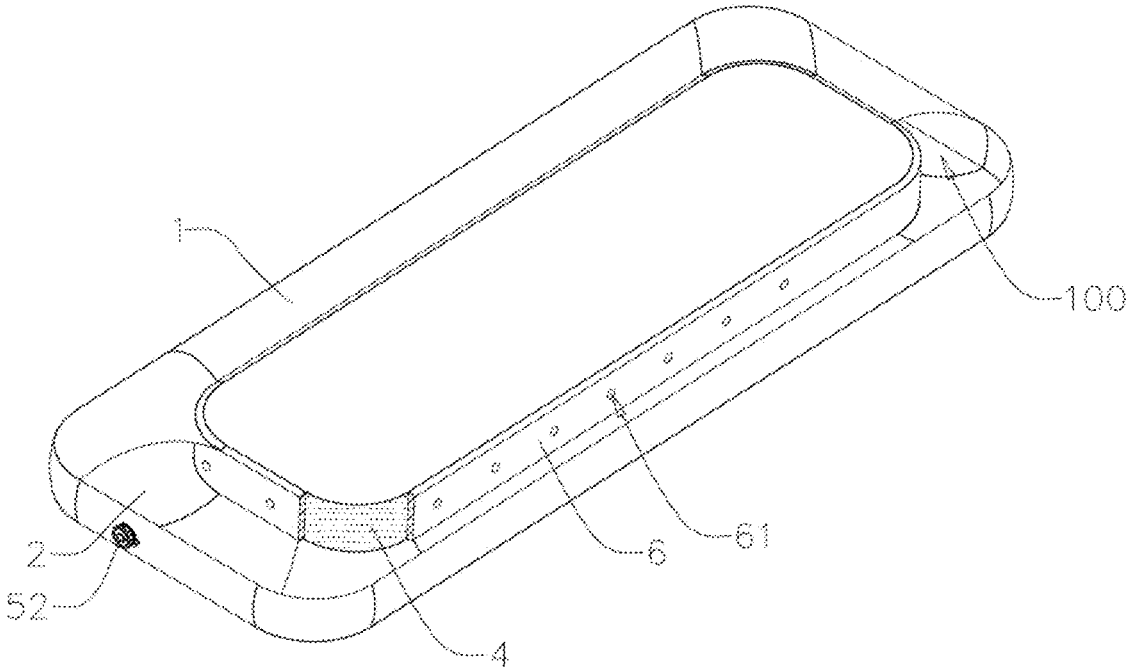
FIG. 3 is a schematic view of a third three-dimensional structure of an inflatable sponge mat according to Embodiment 1 of the present application (wherein the top sheet is partially cut away and the first pull strap is partially cut away).
Figure 4:
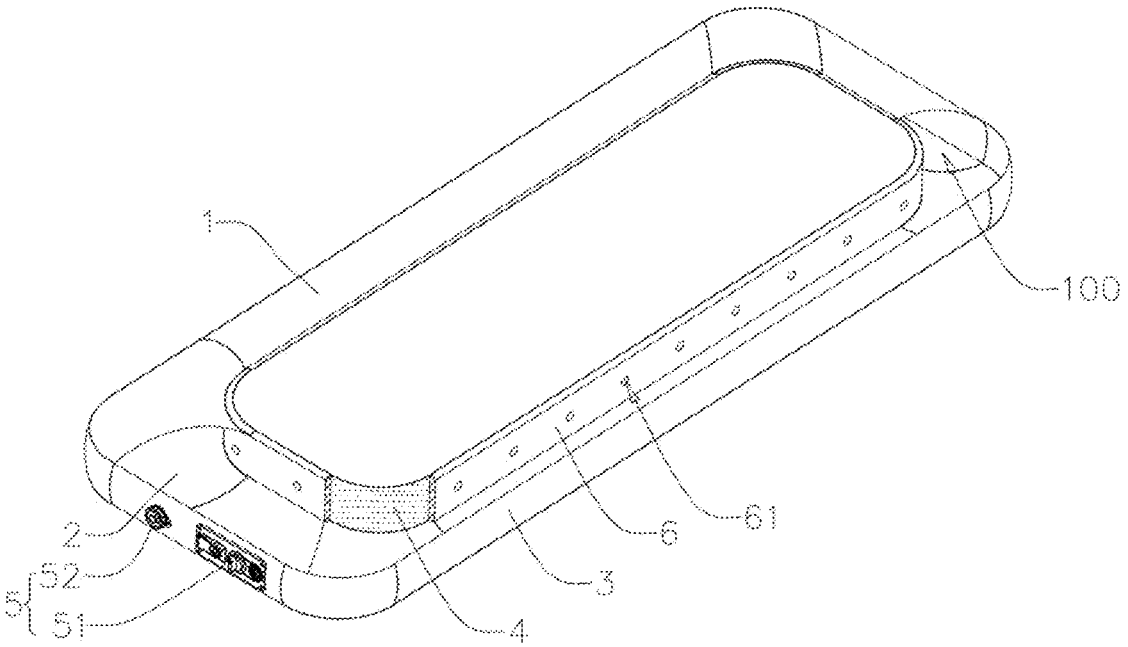
FIG. 4 is a schematic view of a fourth three-dimensional structure of an inflatable sponge mat according to Embodiment 1 of the present application (wherein the top sheet is partially cut away and the first pull strap is partially cut away).

Referring to FIGS. 2 and 3, the side enclosing sheet 3 is provided with an air pumping integrated device 51 or an inflating and deflating air nozzle 52, or as shown in FIG. 4, the side enclosing sheet 3 is provided with the air pumping integrated device 51 and the inflating and deflating air nozzle 52 at the same time. The air pumping integrated device 51 is a common air pump structure with functions of inflating and sucking air integrally in the market, and the inflating and deflating air nozzle 52 is a common air nozzle structure in the market, which can communicate with an external air pumping device to inflate or deflate the air chamber 100. When the air pumping integrated device 51 and the inflating and deflating air nozzle 52 are provided at the same time, the air pumping integrated device 51 and the inflating and deflating air nozzle 52 can be provided on the same side wall or different side walls of the side enclosing sheet 3, both of which are within the scope of protection of the present application.

An implementation principle of Embodiment 1 is: the air pumping integrated device 51 and/or the inflating and deflating air nozzle 52 is fixed at a corresponding position of the side enclosing sheet 3 according to a desired position, the upper surface of the bed mat 4 is fixedly connected to the lower surface of the top sheet 1, and the lower surface of the bed mat 4 is fixedly connected to the upper surface of the bottom sheet 2; then the first pull strap 6 is circumferentially arranged around the side wall of the bed mat 4, and two ends of the first pull strap 6 are connected end to end, and then the first side edge of the first pull strap 6 is connected to the lower surface of the top sheet 1, and the second side edge of the first pull strap 6 is connected to the upper surface of the bottom sheet 2; finally, by connecting the four edges of the top sheet 1 to the top of the side enclosing sheet 3 and the four edges of the bottom sheet 2 to the bottom of the side enclosing sheet 3, the air chamber 100 is formed. Finally, leftovers at each joint are removed, and the inflatable sponge mat is prepared.

When the inflatable sponge mat needs to be used, performing inflation into the air chamber 100 by connecting the inflating and deflating air nozzle 52 with an external air pumping device or directly through an inflation function of the air pumping integrated device 51; alternatively, performing inflation by connecting the external air pumping device with the inflating and deflating air nozzle 52, as well as through the inflation function of the air pumping integrated device 51, to improve inflation efficiency. An inflated air can uniformly flow into the air chamber 100 and enter the micropores of the bed mat 4 through the first through holes 61 or meshes of the first pull strap 6 to realize an inflation process.

When there is no need to use the inflatable sponge mat, the air in the air chamber 100 is deflated and discharged through the inflating and deflating air nozzle 52, and when being stored, the air in the air chamber 100 and the air in the micropores of the bed mat 4 can be squeezed while being rolled up, achieving exhaust storage. In addition, it can also be connected the inflating and deflating air nozzle 52 to the external air pumping device, or directly use an air pumping function of the air pumping integrated device 51 to accelerate an extraction of the air in the air chamber 100 to the outside to facilitate folding and rolling of the inflatable sponge mat, and a volume of the inflatable sponge mat after the folding and rolling is smaller.

Embodiment 2

Figure 5:
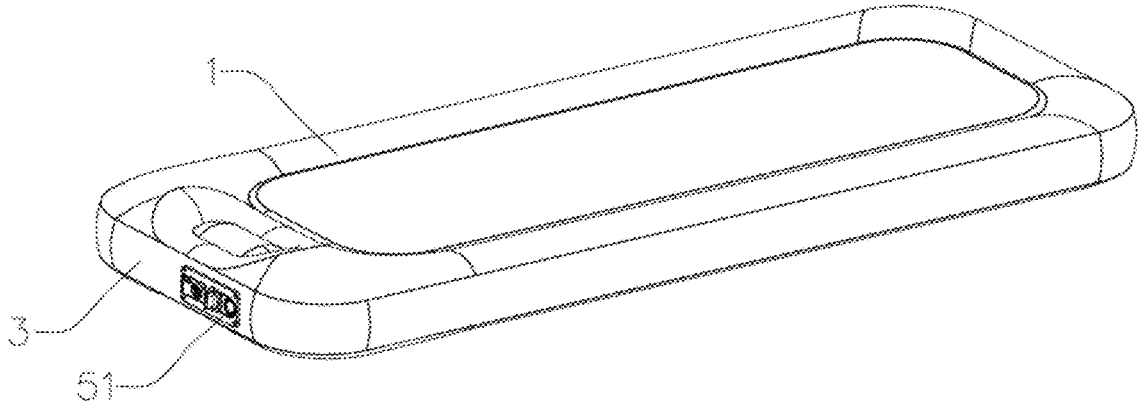
FIG. 5 is a schematic view of a first three-dimensional structure of an inflatable sponge mat according to Embodiment 2 of the present application.
Figure 6:
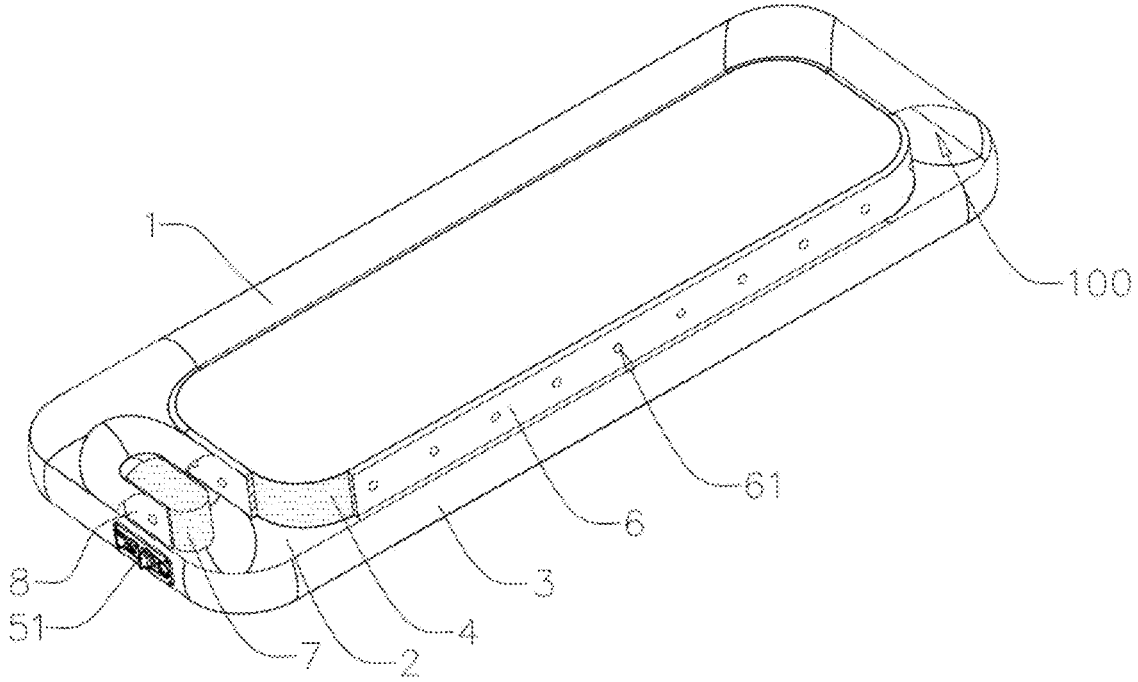
FIG. 6 is a schematic view of a second three-dimensional structure of an inflatable sponge mat according to Embodiment 2 of the present application (wherein the top sheet is partially cut away, the first pull strap is partially cut away, and the second pull strap is partially cut away).

Referring to FIGS. 5-6, the present embodiment differs from Embodiment 1 in that: based on the bed mat 4 and the first pull strap 6 in Embodiment 1, a pillow mat 7 and a second pull strap 8 are further provided in the bed frame structure; further, the pillow mat 7 is provided close to one end portion of the top sheet 1, and two ends of the second pull strap 8 are connected end to end and the second pull strap 8 surrounds a side wall of the pillow mat 7; an upper surface of the pillow mat 7 is fixedly connected to a lower surface of the top sheet 1; a lower surface of the pillow mat 7 is fixedly connected to an upper surface of the bottom sheet 2; a first side edge of the second pull strap 8 located at the top is fixedly connected to the top sheet 1; and a second side edge of the second pull strap 8 located at the bottom is fixedly connected to the bottom sheet 2; the above-mentioned fixed connection method is preferably connected to each other by using the hot-connection or the adhesive process. Specifically, a distance between the lower surface of the top sheet 1 and the upper surface of the bottom sheet 2 is smaller than a height of the pillow mat 7, and a height of the second pull strap 8 is also less than that of the pillow mat 7, so that the top sheet 1, the bottom sheet 2 and the second pull strap 8 can stably wrap around and fix the pillow mat 7; when the air is inflated in the air chamber 100, the upper surface of the pillow mat 7 and the top sheet 1, and the lower surface of the pillow mat 7 and the bottom sheet 2 are not easily peeled away due to the air pressure, ensuring the stability of the inflatable sponge mat in use.

Preferably, the second pull strap 8 is fixedly attached to the side wall of the pillow mat 7, or the second pull strap 8 is not fixedly attached to the side wall of the pillow mat 7, both of which are within the scope of protection of the present application. In addition, the second pull strap 8 is defined with a plurality of second through holes 81, or the second pull strap 8 is the mesh pull strap with a plurality of meshes, both of which are within the scope of protection of the present application. More preferably, a distance is provided between the pillow mat 7 and the bed mat 4, and the pillow mat 7 and the bed mat 4 are non-integrally connected and formed; alternatively, the pillow mat 7 and the bed mat 4 are integrally connected and arranged, specifically being integrally expanded and formed in a bed mould with a pillow structure, or being a structure where the pillow mat 7 and the bed mat 4 are integrally connected by cutting after expanding and forming, both of which are within the scope of protection of the present application.

Figure 7:
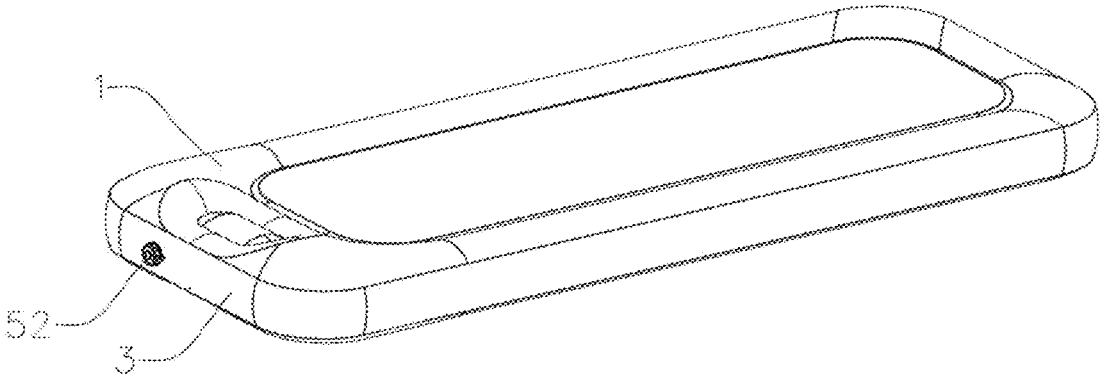
FIG. 7 is a schematic view of a third three-dimensional structure of an inflatable sponge mat according to Embodiment 2 of the present application.
Figure 8:
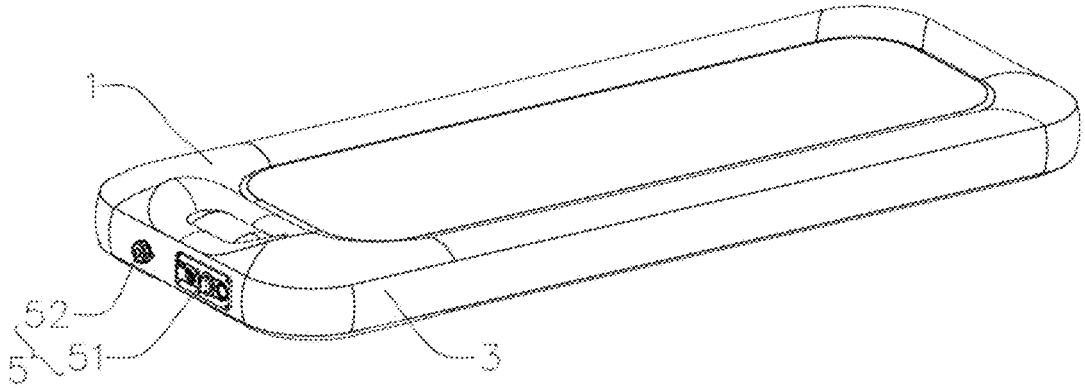
FIG. 8 is a schematic view of a fourth three-dimensional structure of an inflatable sponge mat according to Embodiment 2 of the present application.

Referring to FIGS. 5 and 7, the side enclosing sheet 3 of the present embodiment is provided with the air pumping integrated device 51 or the inflating and deflating air nozzle 52, or as shown in FIG. 8, the side enclosing sheet 3 is provided with the air pumping integrated device 51 and the inflating and deflating air nozzle 52 at the same time. When the air pumping integrated device 51 and the inflating and deflating air nozzle 52 are provided at the same time, the air pumping integrated device 51 and the inflating and deflating air nozzle 52 can be provided on the same side wall or different side walls of the side enclosing sheet 3, and both of which are within the scope of protection of the present application.

The implementation principle of Embodiment 2 is: the air pumping integrated device 51 and/or the inflating and deflating air nozzle 52 is fixed at the corresponding position of the side enclosing sheet 3 according to the desired position, the upper surface of the bed mat 4 and the upper surface of the pillow mat 7 are fixedly connected to the lower surface of the top sheet 1, and the lower surface of the bed mat 4 and the lower surface of the pillow mat 7 are fixedly connected to the upper surface of the bottom sheet 2; then the first pull strap 6 is circumferentially arranged around the side wall of the bed mat 4, and two ends of the first pull strap 6 are connected end to end, and then the first side edge of the first pull strap 6 is connected to the lower surface of the top sheet 1, and the second side edge of the first pull strap 6 is connected to the upper surface of the bottom sheet 2; by the same reasoning, the second pull strap 8 is circumferentially arranged along the side wall of the pillow mat 7, and two ends of the second pull strap 8 are connected end to end, and then the first side edge of the second pull strap 8 is connected to the lower surface of the top sheet 1, and the second side edge of the second pull strap 8 is connected to the upper surface of the bottom sheet 2; finally, by connecting the four edges of the top sheet 1 to the top of the side enclosing sheet 3 and the four edges of the bottom sheet 2 to the bottom of the side enclosing sheet 3, the air chamber 100 is formed. Finally, the leftovers at each joint are removed, and the inflatable sponge mat is prepared.

When the inflatable sponge mat needs to be used, performing inflation into the air chamber 100 by connecting the inflating and deflating air nozzle 52 with an external air pumping device or directly through an inflation function of the air pumping integrated device 51; alternatively, performing inflation by connecting the external air pumping device with the inflating and deflating air nozzle 52, as well as through the inflation function of the air pumping integrated device 51, to improve inflation efficiency. The inflated air can uniformly flow into the air chamber 100 and enter the micropores of the bed mat 4 through the first through holes 61 or meshes of the first pull strap 6, and enter the micropores of the pillow mat 7 through the second through hole 81 or meshes of the second pull strap 8 to realize the inflation process.

When there is no need to use the inflatable sponge mat, the air in the air chamber 100 is deflated and discharged through the inflating and deflating air nozzle 52, and when being stored, the air in the air chamber 100, the air in the micropores of the bed mat 4, the air in the micropores of the pillow mat 7 can be squeezed while being rolled up, achieving exhaust storage. In addition, it can also be connected the inflating and deflating air nozzle 52 to the external air pumping device, or directly use an air pumping function of the air pumping integrated device 51 to accelerate the extraction of the air in the air chamber 100 to the outside to facilitate the folding and rolling of the inflatable sponge mat, and the volume of the inflatable sponge mat after the folding and rolling is smaller.

Embodiment 3

Figure 9:
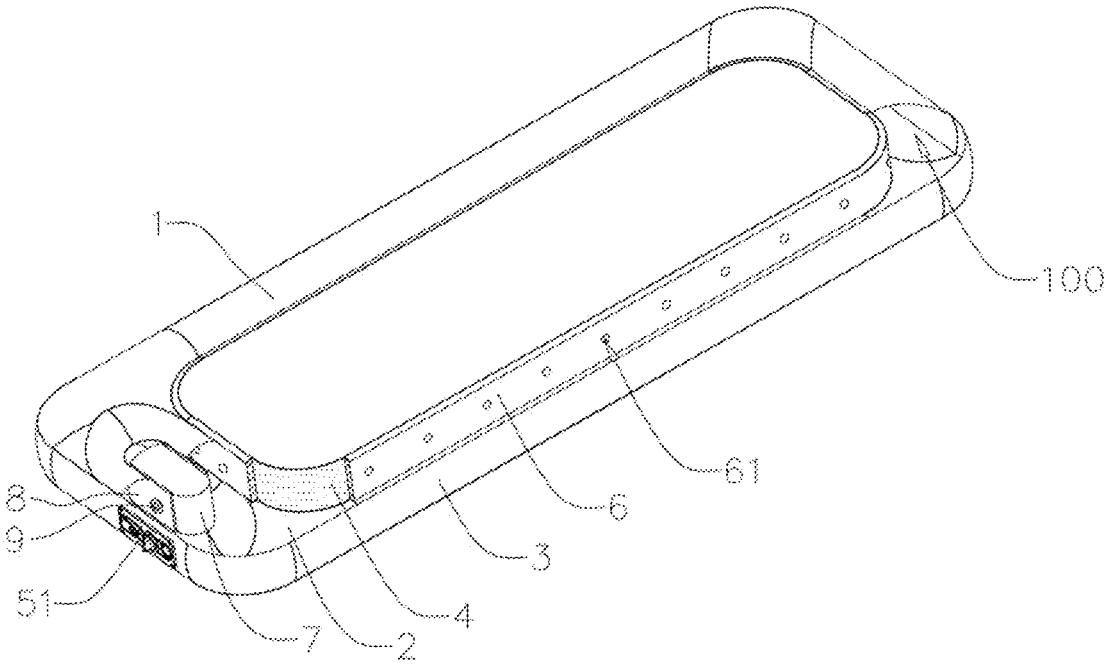
FIG. 9 is a schematic view of a first three-dimensional structure of an inflatable sponge mat according to Embodiment 3 of the present application (wherein the top sheet is partially cut away, the first pull strap is partially cut away, and the second pull strap is partially cut away).
Figure 10:
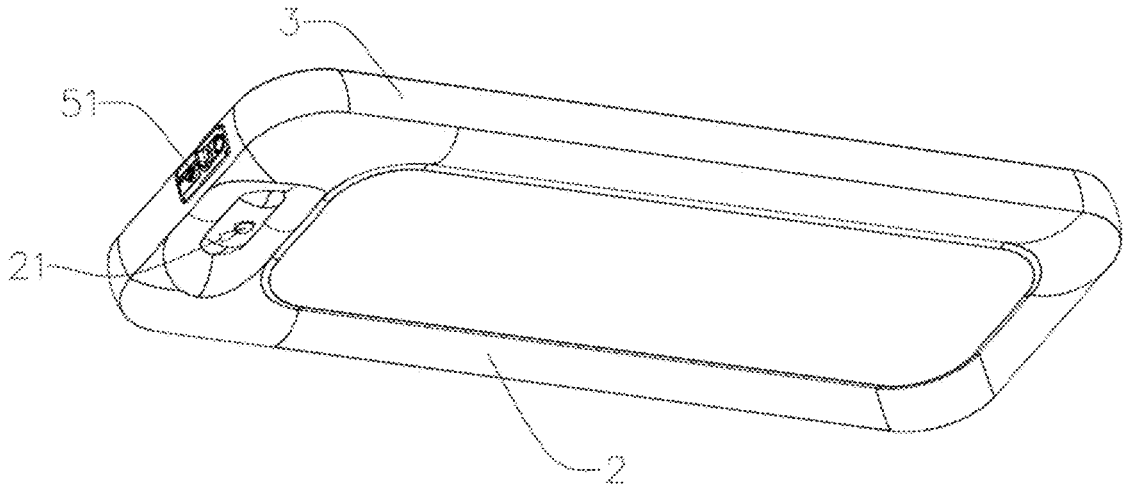
FIG. 10 is a schematic view of a second three-dimensional structure of an inflatable sponge mat according to Embodiment 3 of the present application.

Referring to FIG. 9, the present embodiment differs from Embodiment 2 in that: the second pull strap 8 is not defined with the second through hole 81, and is also not of the mesh pull strap structure. Specifically, a PVC sheet pull strap surrounds the side wall of the pillow mat 7, and the second pull strap 8 is provided with at least one one-way air nozzle 9, and the one-way air nozzle 9 with a common structure of the one-way air nozzle 9 in the market; correspondingly, referring to FIG. 10, the bottom sheet 2 is provided with an air inlet nozzle 21 corresponding to a position of the pillow mat 7.

Figure 11:
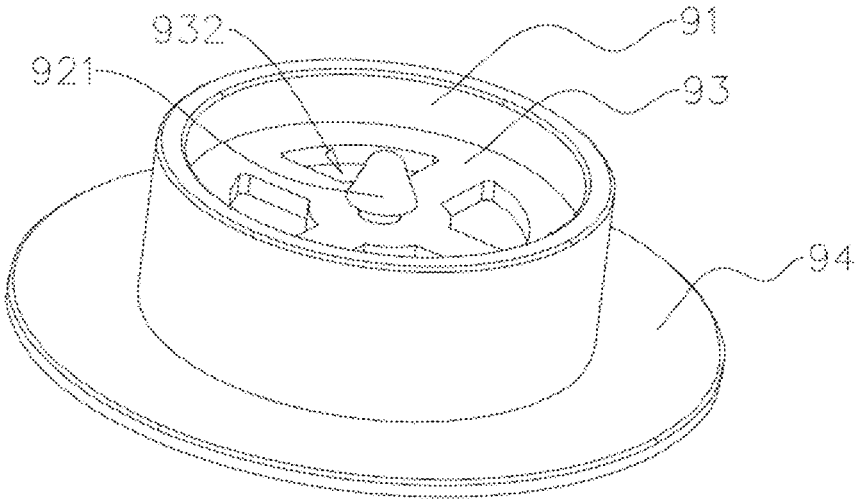
FIG. 11 is a schematic view of a third three-dimensional structure of an inflatable sponge mat according to Embodiment 3 of the present application.
Figure 12:
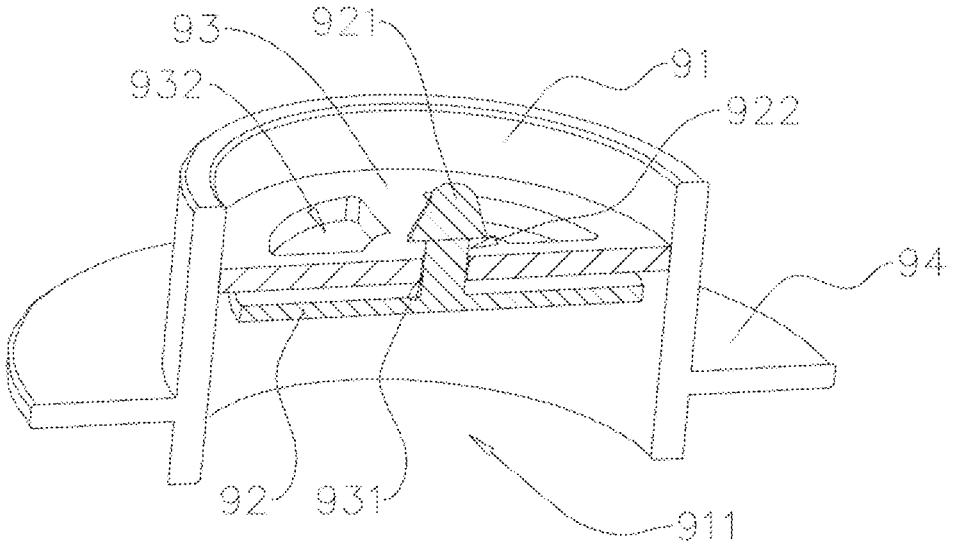
FIG. 12 is a schematic view of a fourth three-dimensional structure of an inflatable sponge mat according to Embodiment 3 of the present application.

As shown in detail in FIGS. 11-12, the one-way air nozzle 9 includes a connecting seat 91 and a one-way diaphragm 92, an outer wall of the connecting seat 91 is provided with a connecting ring 94 arranged in a circumferential direction of the connecting seat 91. Preferably, the connecting ring 94 is provided at a side of the second pull strap 8 close to the pillow mat 7 so that the connecting seat 91 can be stably connected to the second pull strap 8.

In addition, a through hole 911 is defined in a middle of the connecting seat 91, the through hole 911 penetrates through opposite surfaces of the connecting seat 91, and a connecting disc 93 is provided on a hole wall of the connecting seat 91 corresponding to the through hole 911; specifically, the connecting disc 93 is integrally connected with the connecting seat 91, the connecting disc 93 is defined with a connecting hole 931 and a plurality of vents 932, and the one-way diaphragm 92 covers a plurality of vents 932. A connecting column 921 is provided on one surface of the one-way diaphragm 92, specifically, the connecting column 921 is provided on one surface of the one-way diaphragm 92 close to the pillow mat 7, preferably, the connecting column 921 is integrally connected and formed with the one-way diaphragm 92, and is preferably made of soft rubber. Further, a middle of the connecting column 921 is defined with an annular clamping groove 922 along a circumferential direction thereof, so that the top of the connecting column 921 can pass through the connecting hole 931 by being slightly deformed, so that the annular clamping groove 922 is clamped in the connecting hole 931. The end portion of the connecting column 921 is limited to one surface of the connecting disc 93 close to the pillow mat 7, and an axial length of the annular clamping groove 922 is greater than a thickness of the connecting disc 93, so that a part of the connecting column 921 corresponding to the annular clamping groove 922 can move relatively in the connecting hole 931. When the one-way diaphragm 92 abuts against the connecting disc 93, the one-way diaphragm 92 seals the plurality of vents 932, so that the gas cannot flow from a surface of the connecting disc 93 away from the pillow mat 7 to a surface of the connecting disc 93 close to the pillow mat 7; when the one-way diaphragm 92 moves away from the connecting disc 93, the one-way diaphragm 92 unseals the vent 932 such that there is a gap between the connecting disc 93 and the one-way diaphragm 92, which facilitate a flow of gas from the surface of the connecting disc 93 close to the pillow mat 7 to the surface of the connecting disc 93 away from the pillow mat 7, and then into the air chamber 100.

Figure 13:
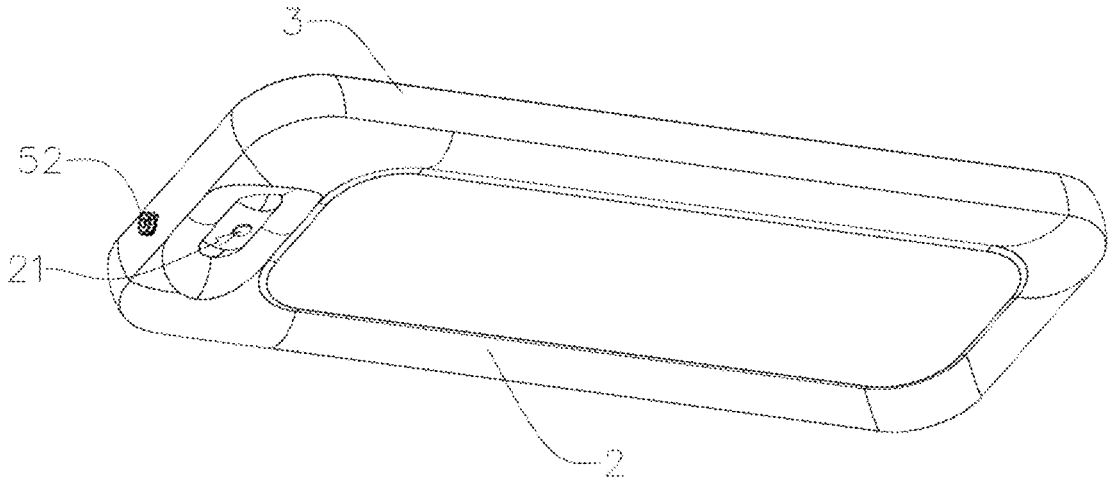
FIG. 13 is a schematic view of a fifth three-dimensional structure of an inflatable sponge mat according to Embodiment 3 of the present application.
Figure 14:
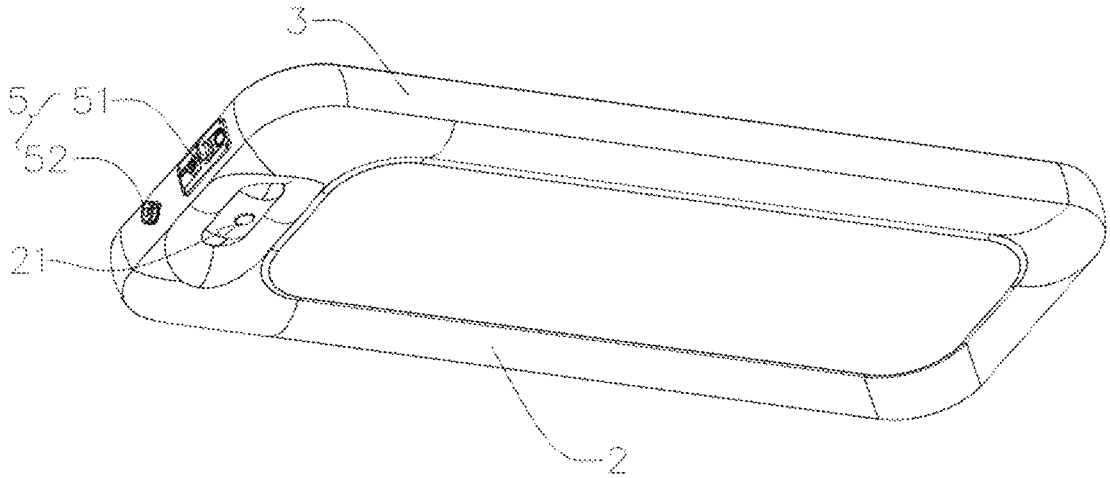
FIG. 14 is a schematic view of a sixth three-dimensional structure of an inflatable sponge mat according to Embodiment 3 of the present application.

Referring to FIGS. 11 and 13, the side enclosing sheet 3 of the present embodiment is provided with the air pumping integrated device 51 or the inflating and deflating air nozzle 52, or as shown in FIG. 14, the side enclosing sheet 3 is provided with the air pumping integrated device 51 and the inflating and deflating air nozzle 52 at the same time. When the air pumping integrated device 51 and the inflating and deflating air nozzle 52 are provided at the same time, the air pumping integrated device 51 and the inflating and deflating air nozzle 52 can be provided on the same side wall or different side walls of the side enclosing sheet 3, and both of which are within the scope of protection of the present application.

The implementation principle of embodiment 3 is: the one-way air nozzle 9 is firstly fixed on the second pull strap 8, and then the second pull strap 8 is arranged around the side wall of the pillow mat 7, in particular, one face of the one-way diaphragm 92 provided with a connecting column 821 is arranged towards the pillow mat 7.

The process of connecting the top sheet 1, the bottom sheet 2, the side enclosing sheet 3, the bed mat 4, the first pull strap 6, the pillow mat 7 and the second pull strap 8 to prepare the inflatable sponge mat is the same as in Embodiment 2, and the description thereof will not be repeated here.

When the inflatable sponge mat needs to be used, performing inflation into the air chamber 100 by connecting the inflating and deflating air nozzle 52 with the external air pumping device or directly through the inflation function of the air pumping integrated device 51; alternatively, performing inflation by connecting the external air pumping device with the inflating and deflating air nozzle 52, as well as through the inflation function of the air pumping integrated device 51. During the process of inflating the air chamber 100 by the air pumping integrated device 51 and/or the inflating and deflating air nozzle 52, a self-inflation and deflation can be achieved by stepping on the pillow mat 7 to further improve the inflation efficiency.

When the pillow mat 7 is stepped on by a foot, the pillow mat 7 is compressed, the volume of the micropores of the pillow mat 7 is reduced, and when a gas pressure in the micropores presses the one-way diaphragm 92 away from the connecting disc 93, the one-way diaphragm 92 unseals the vent 932 such that there is a gap between the connecting disc 93 and the one-way diaphragm 92, which facilitates the flow gas from the surface of the connecting disc 93 close to the pillow mat 7 to the surface of the connecting disc 93 away from the pillow mat 7, then into the air chamber 100. When the compression of the pillow mat 7 is released, the pillow mat 7 returns to an original state due to an own resilience of the pillow mat 7, and a negative pressure is formed in the micropores during the process of returning to the original state, and external air is sucked from the air inlet nozzle 21 into the micropores of the pillow mat 7, and the negative pressure of the micropores of the pillow mat 7 also enables the one-way diaphragm 92 to abut against the connecting disc 93 and seal the vent 932, so that when the pillow mat 7 returns to the original state to suck air, no air is input into the air chamber 100. Such is a self-compressed inflation to an air chamber, a self-resilience air suck to a pillow mat 7 process that is accomplished using the compression resilience of the pillow mat 7.

The inflated air can uniformly flow into the air chamber 100 and enter the micropores of the bed mat 4 through the first through holes 61 or meshes of the first pull strap 6 to realize the inflation process.

When there is no need to use the inflatable sponge mat, the air in the air chamber 100 is deflated and discharged through the inflating and deflating air nozzle 52, and when being stored, the air in the air chamber 100, the air in the micropores of the bed mat 4, the air in the micropores of the pillow mat 7 can be squeezed while being rolled up, achieving exhaust storage. In addition, it can also be connected the inflating and deflating air nozzle 52 to the external air pumping device, or directly use the air pumping function of the air pumping integrated device 51 to accelerate the extraction of the air in the air chamber 100 to the outside to facilitate the folding and rolling of the inflatable sponge mat, and the volume of the inflatable sponge mat after the folding and rolling is smaller.

What is provided above is merely the preferred embodiments according to the present application, and the protection scope of the present application is not limited to the above embodiments. Therefore, any equivalent changes made based on the structure, shape, or principle of the present application should be encompassed within the scope of protection of the present application.

LISTING OF REFERENCE SIGNS

1. top sheet;
2. bottom sheet;
21. air inlet nozzle;
3. side enclosing sheet;
4. bed mat;
5. air pumping assembly;
51. air pumping integrated device;
52. inflating and deflating air nozzle;
6. first pull strap; 61. first through hole;
7. pillow mat;
8. second pull strap;
81. second through hole;
9. one-way air nozzle;
91. connecting seat;
911. through hole;
92. one-way diaphragm;
921. connecting column;
922. annular clamping groove;
93. connecting disc;
931. connecting hole;
932. vent;
94. connecting ring;
100. air chamber.

What is claimed is:

1. An inflatable sponge mat, comprising a top sheet, a bottom sheet, a side enclosing sheet and a bed mat, wherein four edges of the top sheet are connected to a top of the side enclosing sheet, four edges of the bottom sheet are connected to a bottom of the side enclosing sheet, the top sheet, the bottom sheet and the side enclosing sheet enclose to form an air chamber, the bed mat is arranged in the air chamber, an upper surface of the bed mat is fixedly connected to a lower surface of the top sheet, a lower surface of the bed mat is fixedly connected to an upper surface of the bottom sheet, and the side enclosing sheet is provided with an air pumping assembly, wherein the inflatable sponge mat further comprises a first pull strap, the first pull strap surrounds a side wall of the bed mat, a top of the first pull strap is connected to the top sheet, and a bottom of the first pull strap is connected to the bottom sheet, and wherein the first pull strap is defined with a plurality of first through holes.

2. The inflatable sponge mat according to claim 1, wherein the first pull strap is a mesh pull strap.

3. The inflatable sponge mat according to claim 1, wherein a height of the first pull strap is less than that of the bed mat.

4. The inflatable sponge mat according to claim 1, wherein the air pumping assembly is at least one of an air pumping integrated device or an inflating and deflating air nozzle.

5. The inflatable sponge mat according to claim 1, wherein the inflatable sponge mat further comprises a pillow mat, the pillow mat is arranged in the air chamber and close to one end of the top sheet, an upper surface of the pillow mat is fixedly connected to the lower surface of the top sheet and a lower surface of the pillow mat is fixedly connected to the upper surface of the bottom sheet.

6. The inflatable sponge mat according to claim 5, wherein the inflatable sponge mat further comprises a second pull strap, the second pull strap surrounds a side wall of the pillow mat, a top of the second pull strap is connected to the top sheet, and a bottom of the second pull strap is connected to the bottom sheet.

7. The inflatable sponge mat according to claim 6, wherein the second pull strap is defined with a plurality of second through holes.

8. The inflatable sponge mat according to claim 6, wherein the second pull strap is a mesh pull strap.

9. The inflatable sponge mat according to claim 6, wherein the second pull strap is provided with at least one one-way air nozzle, the bottom sheet is provided with an air inlet nozzle at a position corresponding to the pillow mat, and the at least one one-way air nozzle is used for limiting a gas from flowing only from the pillow mat into the air chamber.

10. The inflatable sponge mat according to claim 9, wherein the at least one one-way air nozzle comprises a connecting seat and a one-way diaphragm, a through hole is defined in a middle of the connecting seat, the through hole penetrates through opposite surfaces of the connecting seat, a connecting disc is provided on a hole wall of the connecting seat corresponding to the through hole, the connecting disc is defined with a connecting hole and a plurality of vents, and the one-way diaphragm covers the plurality of vents;

the one-way diaphragm is provided with a connecting column on one surface close to the pillow mat, a middle of the connecting column is defined with an annular clamping groove along a circumferential direction of the connecting column, the connecting column passes through the connecting hole, and the annular clamping groove is clamped in the connecting hole.

11. The inflatable sponge mat according to claim 10, wherein an axial length of the annular clamping groove is greater than a thickness of the connecting disc.

12. The inflatable sponge mat according to claim 10, wherein an outer wall of the connecting seat is provided with a connecting ring along a circumferential direction of the outer wall of the connecting seat, and the connecting ring is fixedly connected to the second pull strap.

13. The inflatable sponge mat according to claim 6, wherein a height of the second pull strap is less than a height of the pillow mat.

14. An inflatable sponge mat, comprising a top sheet, a bottom sheet, a side enclosing sheet and a bed mat, wherein four edges of the top sheet are connected to a top of the side enclosing sheet, four edges of the bottom sheet are connected to a bottom of the side enclosing sheet, the top sheet, the bottom sheet and the side enclosing sheet enclose to form an air chamber, the bed mat is arranged in the air chamber, an upper surface of the bed mat is fixedly connected to a lower surface of the top sheet, a lower surface of the bed mat is fixedly connected to an upper surface of the bottom sheet, and the side enclosing sheet is provided with an air pumping assembly, wherein the inflatable sponge mat further comprises a first pull strap, the first pull strap surrounds a side wall of the bed mat, a top of the first pull strap is connected to the top sheet, and a bottom of the first pull strap is connected to the bottom sheet, and wherein the first pull strap is a mesh pull strap.

15. An inflatable sponge mat, comprising a top sheet, a bottom sheet, a side enclosing sheet and a bed mat, wherein four edges of the top sheet are connected to a top of the side enclosing sheet, four edges of the bottom sheet are connected to a bottom of the side enclosing sheet, the top sheet, the bottom sheet and the side enclosing sheet enclose to form an air chamber, the bed mat is arranged in the air chamber, an upper surface of the bed mat is fixedly connected to a lower surface of the top sheet, a lower surface of the bed mat is fixedly connected to an upper surface of the bottom sheet, and the side enclosing sheet is provided with an air pumping assembly, wherein the inflatable sponge mat further comprises a pillow mat, the pillow mat is arranged in the air chamber and close to one end of the top sheet, an upper surface of the pillow mat is fixedly connected to the lower surface of the top sheet and a lower surface of the pillow mat is fixedly connected to the upper surface of the bottom sheet, wherein the inflatable sponge mat further comprises a pull strap, the pull strap surrounds a side wall of the pillow mat, a top of the pull strap is connected to the top sheet, and a bottom of the pull strap is connected to the bottom sheet, and wherein the pull strap is defined with a plurality of through holes.

* * * * *